United States Patent [19]

Papajewski et al.

[11] 4,395,961

[45] Aug. 2, 1983

[54] UNDERBED THREAD TRIMMER FOR HORIZONTAL AXIS HOOKS

[75] Inventors: Reinhold Papajewski, Stutensee-Friedrichsthal; Dietmar Polixa, Karlsruhe, both of Fed. Rep. of Germany

[73] Assignee: The Singer Company, Stamford, Conn.

[21] Appl. No.: 299,144

[22] Filed: Sep. 3, 1981

[51] Int. Cl.[3] ..... D05B 65/00; D05B 57/08

[52] U.S. Cl. ..... 112/181; 112/291

[58] Field of Search ..... 112/181, 289, 291, 292

[56] References Cited

U.S. PATENT DOCUMENTS

| | | | |
|---|---|---|---|
| 3,424,116 | 1/1969 | Von Hagen | 112/292 |
| 3,443,540 | 5/1969 | Hannemann et al. | 112/289 |
| 3,728,978 | 4/1973 | Honda et al. | 112/292 |

FOREIGN PATENT DOCUMENTS

| | | | |
|---|---|---|---|
| 50-129369 | 10/1975 | Japan . | |
| 50-137239 | 10/1975 | Japan . | |
| 50-158454 | 12/1975 | Japan . | |
| 51-76760 | 6/1976 | Japan . | |
| 52-426 | 1/1977 | Japan . | |
| 52-11618 | 4/1977 | Japan . | |
| 1417320 | 12/1975 | United Kingdom | 112/291 |

*Primary Examiner*—Wm. Carter Reynolds

*Attorney, Agent, or Firm*—Edward P. Schmidt; Robert E. Smith; Edward L. Bell

[57] ABSTRACT

A horizontal axis loop taker is actuated by a loop taker shaft supported in an eccentric opening in a rotatable bearing located immediately adjacent the loop taker. In a first position of the rotatable bearing, a sewing needle may extend through an orifice in a throat plate to cooperate with the loop taker in the formation of stitches. In a second position of the rotatable bearing achieved by rotating the bearing in a direction to locate the eccentric opening, and thereby the loop taker, further from the throat plate, the sewing needle will not cooperate with the loop taker. The increased clearance thus provided between the loop taker and throat plate will more readily accommodate thread severing devices.

5 Claims, 7 Drawing Figures

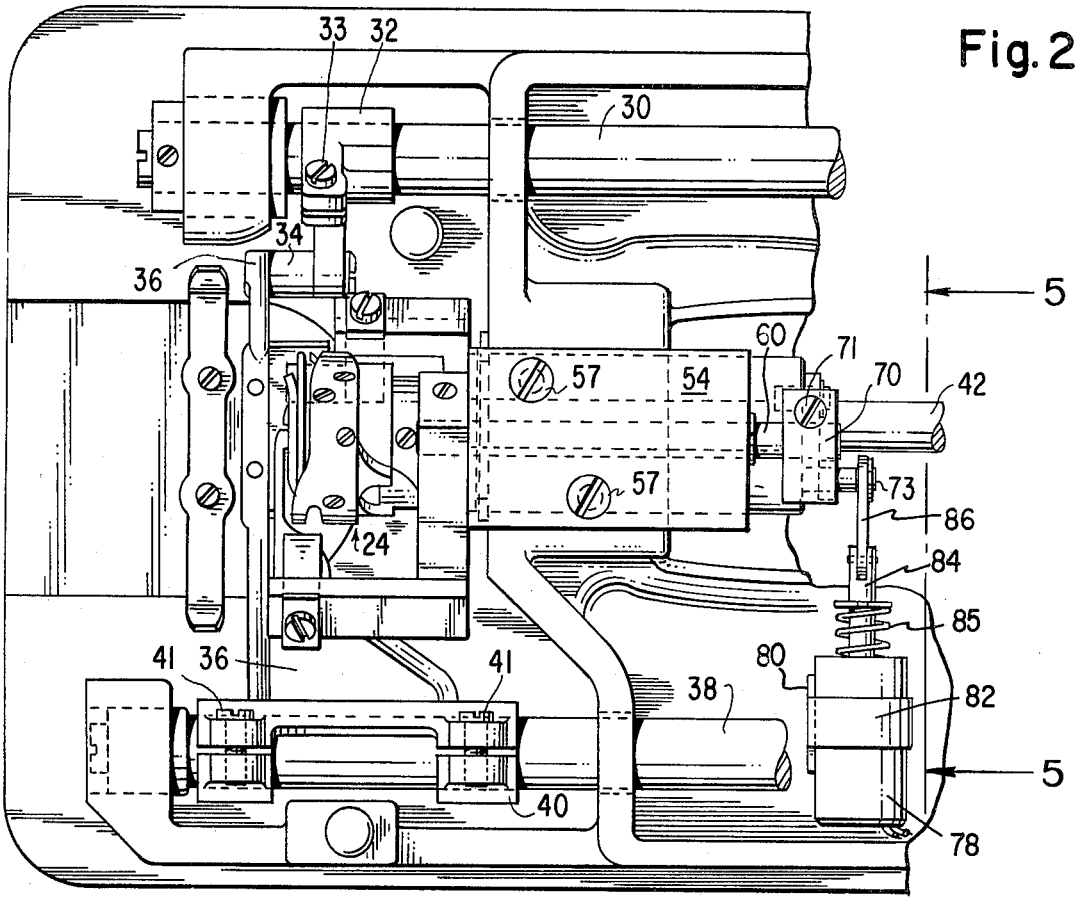
Fig. 2
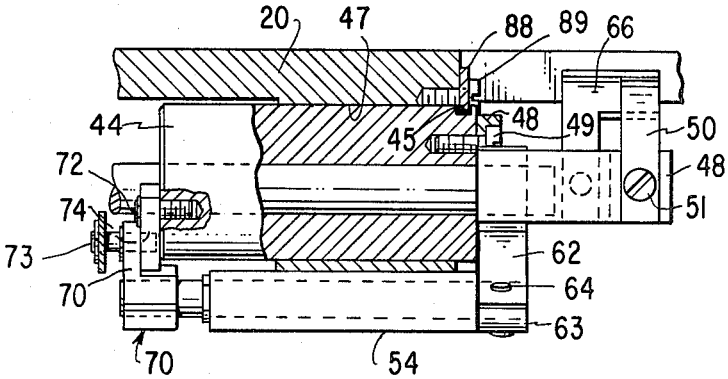
Fig. 4
Fig. 5a
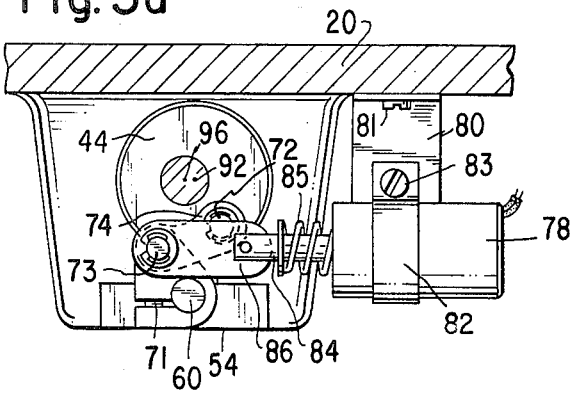
Fig. 5b
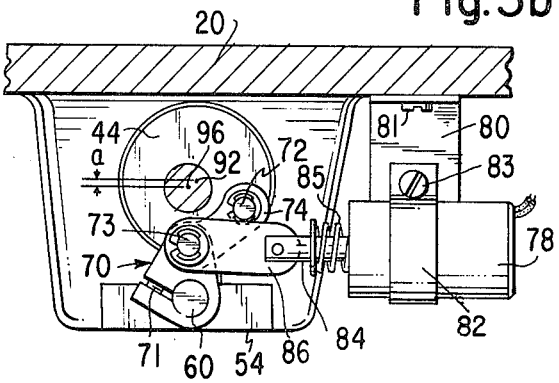

UNDERBED THREAD TRIMMER FOR HORIZONTAL AXIS HOOKS

DESCRIPTION

BACKGROUND OF THE INVENTION

The invention is in the field of sewing machines; more particularly, it is concerned with the means for actuating an underbed thread trimmer therefor.

In known underbed thread trimming devices for sewing machines, threads are severed as closely as possible to the underside of the throat plate in order to have as short a thread end as possible. However, due to the tight clearance conditions between the throat plate and the loop taker for the sewing machine, these mechanisms can be, and usually are, extremely complicated. Ideally, threads are also trimmed as closely as possible to the work material in order to have a sufficient length of thread available to guarantee a safe formation of a subsequent first stitch. However, it frequently occurs that these thread ends are not long enough due to the complexity of these trimming devices and/or the consequent inability to properly control the thread catcher, thread puller and thread trimmer.

What is required is some means of providing additional space between the loop taker and the throat plate which will permit utilization of simpler mechanisms which reliably trim thread closer to the work material.

SUMMARY OF THE INVENTION

The above requirement is found in a sewing machine having a horizontal axis loop taker in which the bearing immediately adjacent the loop taker is arranged with an eccentric bore, and is normally retained in a position in which the loop taker cooperates with the sewing needle in the formation of stitches. However, the bearing may be rotated in a direction to shift the loop taker drive shaft, and loop taker carried thereby, away from the sewing machine throat plate to increase the clearance therebetween. A thread trimming element may be attached to the bearing so as to move therewith into a thread trimming position. Thus, a thread puller and counter knife mounted on the bearing so as to rotate into the increased space provided by the bearing rotation, cooperates with a trimming knife also rotated into that increased space by the same bearing rotating motion.

DESCRIPTION OF THE DRAWINGS

With the above and additional objects and advantages in mind as will hereinafter appear, the invention will be described with reference to the accompanying drawings in which:

FIG. 2 is a bottom plan view of the portion of the sewing machine shown in FIG. 1 indicating the actuation device for the invention;

FIG. 4 is a view taken along line 4—4 of FIG. 3*b* to show the arrangement of the thread puller and trimming elements on the hook shaft bearing supporting the loop taker;

FIG. 5*a* is a view taken along line 5—5 of FIG. 2, showing another view of the actuation device for rotating the bearing in the unactuated position; and, FIG. 5*b* is a view similar to FIG. 5*a* with, however, the bearing thereof actuated into a position to arrange the thread puller and trimmer knife as shown in FIG. 3*b*, and obtain the additional clearance "a" between the looptaker and throat plate.

Referring now to FIG. 1 there is shown a head portion 12 of an industrial sewing machine 10. Extending from the head 12 is a presser bar 14 and a needle bar 16. The presser bar 14 terminates in a presser foot 15 which foot is utilized to press a work material W shown lying on a throat plate 18 supported by the bed 20, against the thrust of feed dogs 21, part of a feed system supported within the bed. A needle 17 is fixed to the end of needle bar 16 and is shown extending through a needle accommodating orifice 19 in the throat plate 18.

Figure 1:
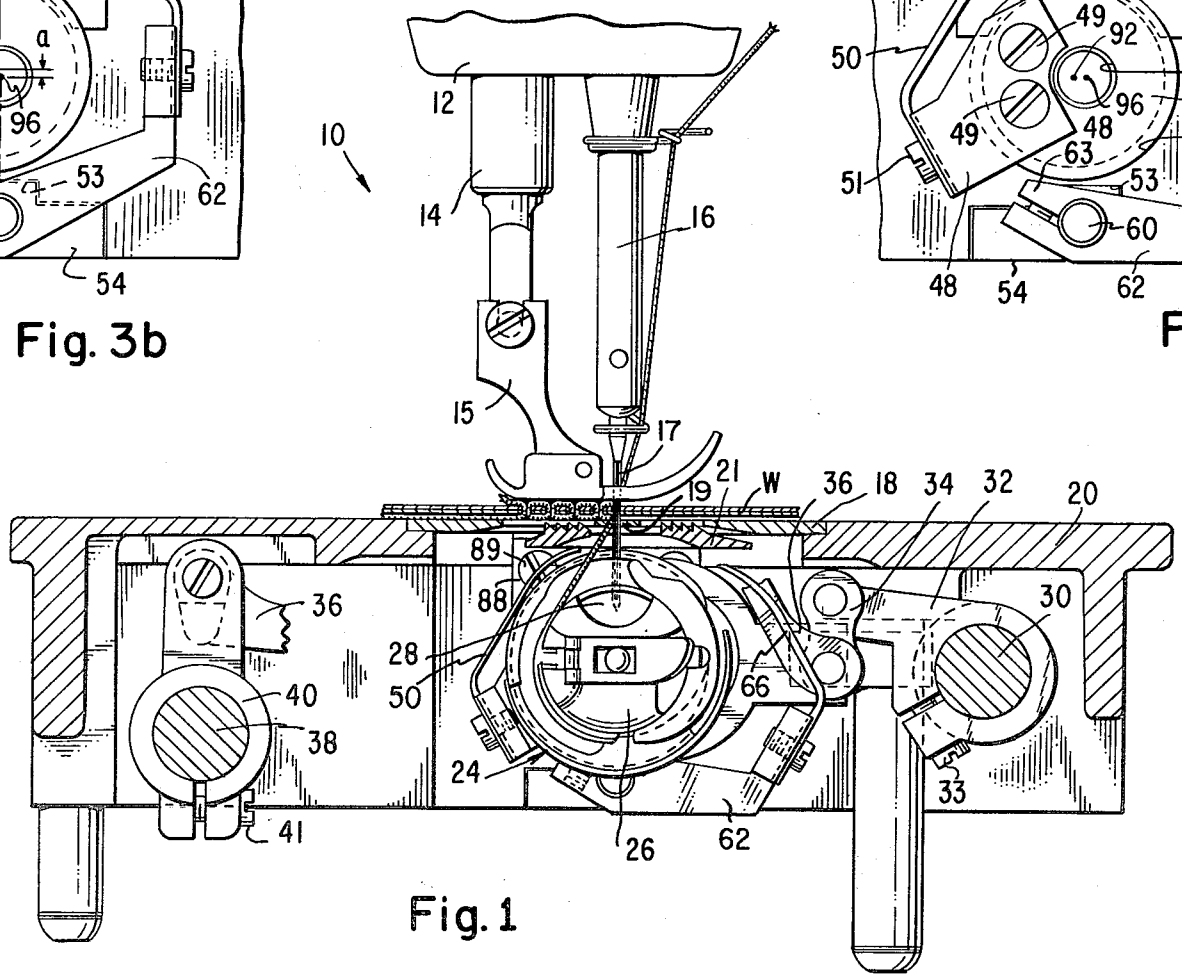
FIG. 1 is a partial head end elevation, partially in section, with the invention applied thereto.

Also visible in FIG. 1 is a loop taker 24 within which is supported a bobbin case 26 retaining therein a bobbin 28 supplying a lower thread for a lockstitch in the work material W. There is also visible a feed lift rock shaft 30 and a feed advance rock shaft 38 which impel the feed dogs 21 into their lifting and advance motion, respectively. A feed lift rock arm 32 is clamped to the feed lift rock shaft 38 by screw 33, and pivotably carries on the end thereof a feed lift connecting link 34, to the other end of which link is connected a feed dog carrier 36. The feed dog carrier 36 is broken off for simplicity sake but the feed dogs 21 are carried thereby. The feed advance rock shaft 38 has clamped thereon by screws 41 a feed advance rock arm 40, the other end of which is pivotably attached to the feed dog carrier 36.

Figure 3A:
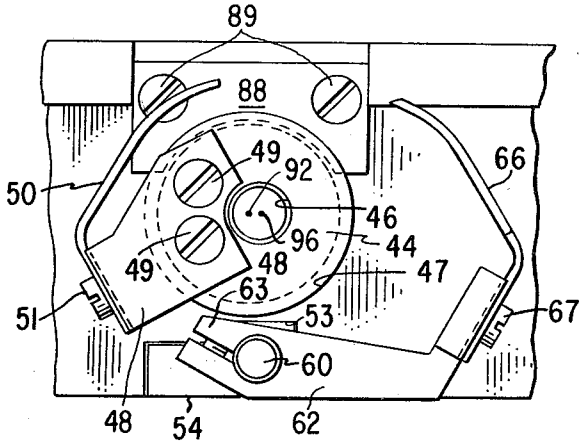
FIG. 3*a* is a view of the loop taker area similar to FIG. 1 with, however, the loop taker and bobbin case removed to show the thread puller and thread trimming elements in their non-actuated position.
Figure 3B:
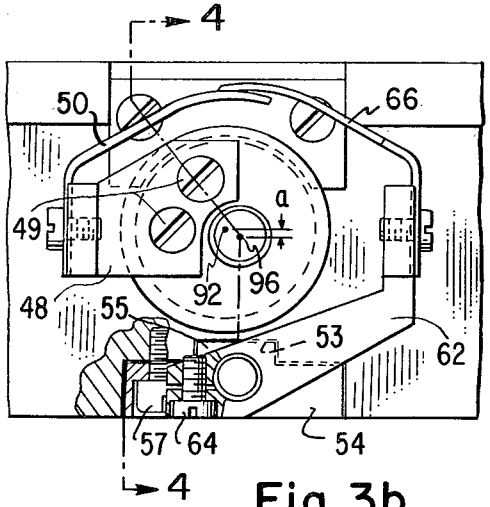
FIG. 3*b* is a view similar to FIG. 3*a* with, however, the thread puller and thread trimming element shown in the actuated position thereof.

Referring now to FIG. 2 there is disclosed the underside of the sewing machine 10 shown in FIG. 1. Visible is the feed lift rock arm 32 carried on the feed lift rock shaft 30 and connected to the feed dog carrier 36 by the feed lift connecting link 34. Also visible is connection of the feed dog carrier 36 to the feed advance rock arm 40, which arm is attached to the feed advance rock shaft 38 by the screws 41. A loop taker drive shaft 42 terminates at the loop taker 24. The loop taker drive shaft 42 extends through a circular bushing 44 by way of eccentrically located opening 46 therein (see FIGS. 3*a*, 3*b*). Referring to FIGS. 3*a* and 3*b*, it can be seen that the circular bushing 44 is carried within an enlarged bore 47 in the bed 20. A plate 48 is attached to the circular bushing 44 by screws 49, the plate carrying thereon a thread puller and counter knife 50 secured thereto by screw 51. The bed 20 is grooved 53 adjacent the bore 47 to receive a tongue 55 of a bearing saddle 54 which is attached to the bed by screws 57 retained in counterbores therein (see FIGS. 2 and 3*b*). A shaft 60 is freely rotatable in a bore in the bearing saddle, the shaft extending from both ends thereof. The forward end of the shaft 60 adjacent the loop taker 24 receives a split end 63 of an arm 62 which split end is spanned by a screw 64 creating a tight fit of the arm to the shaft. The other end of the arm 62 receives a thread trimming knife 66 which is fastened thereto by screw 67.

The shaft 60 extends through the opposite side of the bearing saddle 54 and has a crank 70 clamped thereto by screw 71 extending through the split end thereof (see FIGS. 4 and 5*a*, *b*). The other end of the crank 70 is pivotably connected by a pin 73 to one end of a link 74, the other end of which is pivotably connected to a pin 72 threadedly carried by the circular bushing 44 adjacent the periphery thereof. A solenoid 78 is carried on a bracket 80 affixed to the bed 20 by a screw 81, by means of a clamp 82 attaching the solenoid to the bracket by screw 83. The armature 84 of the solenoid 78 is lightly spring loaded by compression spring 85 to maintain the armature in the extended position when the solenoid 78 is not activated as shown in FIG. 5*a*. When, however, the solenoid 78 is activated, a link 86 connecting the armature 84 to the pin 73 connnecting the crank 70 to the link 74 to form a toggle joint with the pin 73 as apex, rotates the crank 70 and the shaft 60 to which it is attached, thereby rotating the circular bushing 44 within the bore 47 in the bed 20 (see FIG. 5*b*).

As seen in FIG. 4, the circular bushing 44 is fashioned with a peripheral groove 45 on its upper extremity. A guide plate 88 is fastened by screws 89 to the sewing machine bed 20 and extends into this peripheral groove 45 to retain the circular bushing 44 against axial shift. The rotation of the shaft 60 occassioned by activation of the solenoid 78, urges the arm 62 and thread trimming knife 66 attached thereto, counterclockwise as viewed in FIG. 3*a*. The thread puller and counter knife 50 in this rotation of the circular bushing 44, picks up needle and bobbin thread during its clockwise rotation about the loop taker 24 and cooperates with the thread trimming knife 66 which is rotated counterclockwise by the shaft 60, these elements operating in the additional space "*a*" provided by the invention which is apparant by inspection of FIGS. 3*a* and *b* and FIGS. 5*a* and *b*. In FIG. 3*a*, where the thread puller and counter knife 50 and the thread trimming knife 66 are not being utilized, the center of the circular bushing 44 and first axis is at 92 and the center of the eccentric opening 46 and second axis which determines the position of the loop taker 24 is at 96, both centers being at substantially the same distance from the work supporting surface of the bed 20, so that the first axis and second axis lie in a plane substantially parallel to the work supporting bed. In FIG. 3*b*, showing the position assumed by the thread puller and counter knife 50 and thread trimming knife 66 when the solenoid 78 has been activated, the circular bushing 44 has been rotated about its own center 92 or first axis which remains in the same location, but the center or second axis 96 of the eccentric opening 46, and therefore, of the shaft 60 and loop taker 24 has been shifted downwardly and away from the work supporting surface of the bed 20 by a distance "*a*". The plane referred to above has been rotated about the first axis 92 to place the second axis 96 further from the work supporting surface of the bed 20. Thus, the original clearance between the loop taker 24 and the throat plate 18 is increased by the increment "*a*" indicated in FIG. 3*b*, as the distance the center 96 of the eccentric opening 46 is below the center 92 of the circular bushing 44.

Thus, has been disclosed a means which may be used for actuating thread trimming elements which, simultaneously, provides additional clearance for the interposition of these thread trimming elements between the loop taker 24 of the sewing machine and the throat plate 18 thereof, in order to obtain the closest possible trim of the threads extending from the work material. The additional clearance is achieved by repositioning the loop taker drive shaft 42. In order to accommodate this repositioning of one end of the loop taker drive shaft 42, a universal joint may be required therein or, alternatively, a self aligning bearing may be used to support the other end of the loop taker drive shaft.

Numerous alterations of the structure herein disclosed will suggest themselves to those skilled in the art. However, it is to be understood that the present disclosure relates to a preferred embodiment of the invention which is for purposes of illustration only and will not be construed as a limitation of the invention. All such modifications which do not depart from the spirit of the invention are intended to be included within the scope of the appended claims.

We claim:

1. a sewing machine comprising a frame, stitch forming means including a needle bar supported by said frame for to and fro motion, a needle supported in the end of said needle bar, a throat plate supported by said frame, a needle accommodating orifice extending through said throat plate for accommodating said needle extending therethrough in the to and fro motion imparted to said needle by said needle bar, a horizontal axis loop taker disposed adjacent said throat plate for cooperation with said needle extending therethrough in the formation of stitches, means disposed adjacent said loop taker for severing threads at the end of a series of stitches, means for actuating said thread severing means, and means for increasing the clearance between said loop taker and said throat plate when said thread severing means are actuated.

2. A sewing machine as claimed in claim 1 wherein said actuating means for said horizontal axis loop taker further comprises a loop taker shaft for urging said loop taker into loop taking motion, and wherein said clearance increasing means further comprises a bearing supported by said frame adjacent said loop taker for rotation about a first axis, said bearing having a bore therethrough for supporting said loop taker shaft on a second axis spaced from said first axis.

3. A sewing machine as claimed in claim 2 wherein said frame further comprises a work supporting bed for supporting a work material passing between said needle carried by said needle bar and said throat plate with said needle accommodating orifice extending therethrough; and wherein said first axis and said second axis of said bearing are disposed parallel to each other and, a first position wherein said needle cooperates with said loop taker in the formation of stitches, lie in a plane substantially parallel to said work supporting surface and, in a second position wherein said clearance between said loop taker and said throat plate is increased, lie in a plane including said first axis and rotated thereabout to place said second axis further from said work supporting surface, whereby said loop taker is moved an increased distance away from said throat plate.

4. A sewing machine as claimed in claim 3 wherein said clearance increasing means further comprises a toggle joint extending between said frame and the periphery of said bearing, and a solenoid connected to the apex of said toggle joint, whereby activation of said solenoid will rotate said bearing .

5. A sewing machine as claimed in claim 4 wherein said bearing further includes a groove extending over a portion of the periphery thereof, said frame supports a rail extending into said groove, whereby rotation of said bearing may be accomplished without axial displacement thereof.

* * * * *